US010330318B2

(12) United States Patent
Vogtmann et al.

(10) Patent No.: US 10,330,318 B2
(45) Date of Patent: Jun. 25, 2019

(54) SECURING A HEAT SHIELD BLOCK TO A SUPPORT STRUCTURE, AND HEAT SHIELD

(71) Applicant: Siemens Aktiengesellschaft, Munich (DE)

(72) Inventors: Daniel Vogtmann, Dusseldorf (DE); Sabine Grendel, Oberhausen (DE); Claus Krusch, Essen (DE); Andre Kluge, Dulmen (DE); Hartwig Dümler, Cologne (DE); Christopher Grandt, Essen (DE); Andreas Bottcher, Mettmann (DE); Tobias Krieger, Oberhausen (DE); Patrick Lapp, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 531 days.

(21) Appl. No.: 14/898,138

(22) PCT Filed: Jun. 27, 2014

(86) PCT No.: PCT/EP2014/063705
§ 371 (c)(1),
(2) Date: Dec. 13, 2015

(87) PCT Pub. No.: WO2014/207207
PCT Pub. Date: Dec. 31, 2014

(65) Prior Publication Data

US 2016/0131362 A1 May 12, 2016

(30) Foreign Application Priority Data

Jun. 27, 2013 (DE) ..... 10 2013 212 509

(51) Int. Cl.
*F23R 3/60* (2006.01)
*F23R 3/00* (2006.01)
*F23M 5/04* (2006.01)

(52) U.S. Cl.
CPC ..... *F23R 3/002* (2013.01); *F23M 5/04* (2013.01); *F23R 3/007* (2013.01)

(58) Field of Classification Search
CPC .. F23R 3/002; F23R 3/007; F23R 3/60; F23R 3/06; F05D 2260/31
See application file for complete search history.

(56) References Cited

U.S. PATENT DOCUMENTS 4,820,097 A * 4/1989 Maeda ..... F02K 1/80 165/134.1
6,361,273 B1 3/2002 Eng et al.
(Continued)

FOREIGN PATENT DOCUMENTS

CN 1269459 A 10/2000
CN 101922728 A 12/2010
(Continued)

OTHER PUBLICATIONS

English Translation of EP 1884713 A1.*
(Continued)

*Primary Examiner* — William H Rodriguez
*Assistant Examiner* — Thomas P Burke
(74) *Attorney, Agent, or Firm* — Beusse Wolter Sanks & Maire

(57) ABSTRACT

A heat shield with support structure and a number of heat shield blocks secured thereto, having a cold side facing the support structure and a hot side opposite the cold side. At least one recess is arranged in at least one heat shield block circumferential face, connecting the cold to hot side. An opening connecting the recess to the cold side runs in the
(Continued)

circumferential face perpendicularly to the cold side. A securing bolt inserted into the opening secures the heat shield block to the support structure. A bolt head protrudes at least partly into the recess. The securing bolt passes through an angled plate having first limb extending substantially parallel to the circumferential face and second limb extending into the recess. The angled plate has a reinforcing device extending beyond the pure angular shape to increase a resistance of the angled plate against bending due to the securing bolt.

21 Claims, 9 Drawing Sheets

(56) References Cited

U.S. PATENT DOCUMENTS

| | | | | |
|---|---|---|---|---|
| 2006/0176671 | A1* | 8/2006 | Heilos | F23M 5/04 361/704 |
| 2007/0151249 | A1 | 7/2007 | Barbeln et al. | |
| 2009/0056339 | A1* | 3/2009 | Fischer | F23M 5/04 60/752 |
| 2009/0202956 | A1 | 8/2009 | Tschirren et al. | |
| 2010/0251722 | A1* | 10/2010 | Woolford | F23R 3/002 60/755 |
| 2010/0307162 | A1* | 12/2010 | Bottcher | F23M 5/04 60/752 |

FOREIGN PATENT DOCUMENTS

| | | | | |
|---|---|---|---|---|
| CN | 102460022 | A | 5/2012 | |
| EP | 1561997 | A1 | 8/2005 | |
| EP | 1591724 | A1 * | 11/2005 | F23M 5/04 |
| EP | 1884713 | A1 * | 2/2008 | F23M 5/02 |
| EP | 1884713 | B1 | 12/2010 | |
| EP | 2538140 | A2 | 12/2012 | |
| WO | 2005071320 | A1 | 8/2005 | |
| WO | 2008017550 | A1 | 2/2008 | |
| WO | 2010142510 | A1 | 12/2010 | |

OTHER PUBLICATIONS

English Translation of EP 1591724 A1.*

CN Office Action dated Jul. 13, 2016, for CN application No. 201480036829.5.

* cited by examiner

SECURING A HEAT SHIELD BLOCK TO A SUPPORT STRUCTURE, AND HEAT SHIELD

CROSS REFERENCE TO RELATED APPLICATIONS

This application is the US National Stage of International Application No. PCT/EP2014/063705 filed Jun. 27, 2014, and claims the benefit thereof. The International Application claims the benefit of German Application No. DE 102013212509.7 filed Jun. 27, 2013. All of the applications are incorporated by reference herein in their entirety.

FIELD OF INVENTION

The invention relates to securing a heat shield block to a support structure, and relates to a heat shield, to a combustion chamber lined by the heat shield and to a gas turbine.

BACKGROUND OF INVENTION

In many technical applications, heat shields which must resist hot gases at 1000 to 1600 degrees are used. Particularly gas turbines of the kind used in power-generating plants and in aircraft engines have correspondingly large surfaces to be shielded by heat shields within the combustion chambers. Because of thermal expansion and large dimensions, the heat shield must be composed of a multiplicity of individual heat shield blocks, which are generally ceramic and are secured to a support structure in a manner spaced apart by a sufficient gap. This gap gives the heat shield blocks, which can also be referred to as heat shield elements, sufficient space for thermal expansion.

A heat shield of the type in question thus comprises a support structure and a number of heat shield blocks, which are secured, in particular releasably secured, to the support structure. Each of the heat shield blocks has a cold side facing the support structure and a hot side opposite the cold side, which can be subjected to a hot medium. In at least one heat shield block, at least one recess is arranged in at least one circumferential side of the heat shield block, said circumferential side connecting the cold side to the hot side, wherein an aperture, which connects the recess to the cold side, extends in the circumferential side perpendicularly to the cold side. A securing bolt can be inserted into the aperture to secure the heat shield block to the support structure, with the result that a bolt head of the securing bolt projects at least partially into the recess. At the same time, the securing bolt passes through an angled plate in a penetration region. The angled plate comprises a first limb, which extends substantially parallel to the circumferential side, and a second limb, which extends into the recess. The two limbs adjoin each other at an angle edge. Such a method of securing the heat shield block, in particular by means of two recesses on each of two opposite circumferential sides, is particularly well-suited to securing an end block of a row of heat shield blocks arranged around the combustion chamber wall. The end blocks are also referred to as dummy blocks.

EP 1 884 713 B1 discloses a heat shield of the type in question in which the heat shield blocks are secured to the support structure in rows arranged coaxially with a longitudinal axis of a combustion chamber. In this arrangement, the heat shield blocks of one row are held by holding elements, which are inserted into a securing groove extending in the support structure, wherein the holding elements of the subsequent heat shield blocks are inserted into the securing groove after the holding elements of the preceding heat shield block have been secured, and they lock the preceding holding elements. In the case of the known heat shield, the dummy blocks are fixed on the support structure by means of a fastener that can be screwed into the support structure. On two opposite circumferential sides of the heat shield block, said sides connecting the cold side to the hot side, these dummy blocks have two recesses. In association with each of these recesses there is an aperture in the circumferential side, said aperture extending perpendicularly to the cold side and connecting the recess to the cold side. To secure the dummy block to the support structure, a securing bolt is inserted into each of the four apertures, with the result that a bolt head of the securing bolt projects into the recess. To ensure better distribution of the pressure exerted on the heat shield block by the bolt head, an angled plate is arranged underneath the bolt head. The securing bolt passes through the angled plate in a penetration region, with the result that the angled plate extends underneath the bolt head by means of a limb projecting into the recess and covers the aperture in which the securing bolt extends by means of a limb extending substantially parallel to the circumferential side. Slipping of the securing bolt out of the aperture can lead to a loss of the heat shield block. During operation, this can give rise to damage to the combustion chamber lined with the heat shield.

SUMMARY OF INVENTION

It is an underlying object of the invention to indicate a heat shield having at least one heat shield block of the type stated at the outset, the securing of which avoids detachment of the heat shield block from the support structure in a particularly reliable manner.

For this purpose, the angled plate comprises a reinforcing device which goes beyond the pure angular shape. The reinforcing device increases the resistance of the angled plate to bending caused by the securing bolt.

The invention is based on the realization that the securing of the heat shield block as described in the preamble can be significantly improved by developing the reliability of the angular plate. Redesign of the securing bolt, the recess, the amount of cooling air or of the entire securing concept is thus not necessary.

The invention ensures the securing of the heat shield block by means of a reinforcing device on the angled plate. This prevents displacement of the angled plate, which can result in the securing bolt slipping out of the aperture.

According to aspects of the invention, the reinforcing device does not involve a change in the material of the angled plate or a uniform increase in the thickness of the angled plate since such reinforcing devices would not go beyond the pure angular shape.

The term "angled plate" is not to be taken as restrictive as regards the choice of material for the angled plate. The term "heat shield block" is not to be taken as restrictive as regards the choice of material. The heat shield block is in particular composed of a ceramic material.

The heat shield blocks configured in accordance with the invention can be isolated heat shield blocks of the heat shield. For example, they can be merely the dummy blocks. However, it is also possible, for example, for all the heat shield blocks of the heat shield to be configured in accordance with the invention. In this case, all the heat shield blocks would be arranged on the support structure by means of at least one such securing means comprising a securing bolt and an angled plate. The recess can be a holding pocket arranged in the circumferential side, for example. According to another example, it would also be possible for the recess to be a holding groove extending along the circumferential side, into which a plurality of mutually spaced apertures open, thus allowing a plurality of securing bolts to be arranged on this side of the heat shield block.

To explain the concept of the reinforcing device according to the invention, a number of illustrative embodiments, which is not to be taken as restrictive, is given below, it also being possible to combine these with one another to give a reinforcing device according to the invention. For example, the reinforcing device can extend at least partially behind the penetration region, as seen from the angle edge, and reinforce this region, thus increasing resistance of the angled plate to bending caused by the securing bolt. In this case, the reinforcing device can be in the form of a web welded onto the second limb, for example. The web can extend parallel to the angle edge over the entire width of the second limb, for example. However, the web could also span the region behind the penetration region in the form of an arc, for example. Another illustrative embodiment of the reinforcing device can provide profiling of the angled plate, e.g. undulating profiling of the second limb. According to another illustrative embodiment of the reinforcing device, the reinforcing device can also additionally extend underneath the bolt head, for example.

It is advantageously possible to provide for at least one surface of the reinforcing device to at least partially reflect cooling air emerging at the side of the bolt head.

While the heat shield block is being subjected to hot gas, cooling air is passed through the securing bolt, for example. The cooling air flows through a cooling air duct which extends in the securing bolt and comprises at least one cooling air opening at the side of the bolt head, with the result that cooling air emerges at the side of the bolt head. According to another illustrative embodiment, the cooling air can be guided along the aperture at the side of the securing bolt shank, with the result that the cooling air emerges at the side of the bolt head in the region of the penetration region.

This configuration increases a dwell time of the cooling air in the region of the angled plate, ensuring that said plate is more effectively cooled during operation. In this case, the cooling air can impinge directly on the surface or can redirect cooling air which has already been reflected. Owing to the improved cooling of the angled plate, the configuration of the invention according to the invention increases the dimensional stability of the plate, ensuring that the angled plate has increased resistance to bending caused by the securing bolt.

The surface can be a lateral surface, facing toward the bolt head, of undulating profiling of the second limb. This illustrative embodiment of the reinforcing device combines two advantages. By virtue of the profiling, the angled plate is reinforced mechanically against deflection and, at the same time, increased cooling of the angled plate is ensured in a manner according to the invention. The surface can also be a lateral surface, facing toward the bolt head, of the first side wall described in greater detail below, of the angled side wall or of the shielding side wall of the reinforcing device.

It can also be regarded as advantageous that the reinforcing device comprises a first side wall, which is arranged in the region of the inlet opening of the recess in such a way that the first side wall at least partially closes the inlet opening of the recess.

This embodiment of the invention allows significantly improved cooling of the second limb, which is particularly at risk in respect of deflection of the angled plate. The cooling air emerging at the side of the bolt head of the securing bolt remains in the region of the recess for a relatively long period of time. The first side wall can extend along the angle edge and be welded to the latter in the form of a web, for example. According to another illustrative embodiment of the configuration of the invention, the angled plate with the first side wall can also be implemented by two plates welded to one another in a T shape, for example. However, it is also possible to arrange the first side wall on the angled plate in some other way, e.g. indirectly by means of further side walls of the reinforcing device.

An advantageous configuration of the invention can provide for the first side wall of the reinforcing device to close the inlet opening of the recess substantially completely.

In this case, the cooling effect of the reinforcing device is so good that there is no longer a need to consider the mechanical stability of the first side wall to increase the resistance of the angled plate.

Another advantageous configuration of the invention can provide for the first side wall to be arranged substantially at right angles on a second side wall of the reinforcing device. The second side wall extends along the second limb and comprises an opening in alignment with the penetration region of the second limb.

The second side wall can be arranged on the second limb by means of a material bond, for example, and holds the first side wall in the inlet opening of the recess. In other words, the angled plate is joined to a second angled plate to form the first side wall. In this arrangement, one limb of the second angled plate extends parallel to the second limb of the first angled plate and is arranged thereon. In this case, the first side wall is formed by the other limb of the second angled plate. This illustrative embodiment additionally increases the dimensional stability of the angled plate by means of the double plate layer on the second limb.

It is furthermore advantageously possible to envisage that the securing bolt comprises at least one cooling air duct, which opens at the side of the bolt head in at least one outlet opening, wherein an aperture extending as far as the circumference of the opening is arranged in the second side wall in the region of at least one outlet opening of the cooling air duct.

The at least one aperture can be in the form of a groove which ends in an outlet. Owing to impact cooling of its side walls and, in particular, impact cooling of its outlet, the aperture increases the cooling effect of the cooling air conveyed in the aperture. When the heat shield block is subjected to hot gas, this leads to improved cooling, in particular of the second side wall and of the second limb of the angled plate.

It is furthermore advantageously possible to provide for the reinforcing device to extend at least partially behind the penetration region, as seen from the angle edge, and to reinforce this region.

This advantageous configuration of the invention reinforces a region of the angled plate which is particularly narrow owing to the penetration region.

It can also be regarded as advantageous for the second limb of the angled plate or the second side wall of the reinforcing device to comprise, on its side opposite the angle edge, a side wall which is angled in the opposite direction to the angle edge, extends at least partially behind the penetration region, as seen from the angle edge, and reinforces this region.

The angled side wall increases the dwell time of cooling air in the region of the angled plate and serves simultaneously to provide mechanical reinforcement of the particularly narrow region of the angled plate behind the penetration region. This configuration of the invention can be implemented in combination with undulating profiling of the angled plate, for example, or can form the reinforcing device alone, for example. The side wall angled in the opposite direction to the angle edge can be produced by bending a corresponding part of the second limb, for example. However, the side wall can also be arranged on the second limb in some other way. The angle between the limb and the angled side wall is advantageously substantially a right angle.

To further enhance the cooling effect and hence the dimensional stability of the angled plate, provision can advantageously be made for a shielding side wall, which extends in the direction of the inlet opening of the recess, to be arranged on the angled side wall with a vertical clearance.

The shielding side wall advantageously extends substantially parallel to the second limb.

The shielding side wall can extend as far as the inlet region of the recess, for example. Depending on the vertical clearance, the shielding side wall can comprise an aperture for the bolt head or at least one opening for an assembly tool. This configuration of the invention has several advantages. The shielding side wall shields the second limb against the entry of hot gas. Moreover, a cooling air space, which is delimited by the angled side wall and the shielding side wall and into which cooling air emerging at the side of the bolt head of the securing bolt is directed back onto the angled plate, with the result that the dwell time of the cooling air in the recess is increased, is achieved. After a certain time, the cooling air flows out of the recess and enters the combustion chamber through the expansion gaps between the heat shield blocks. The longer the cooling air remains in the recess, the better is the cooling of the angled plate. Moreover, impact cooling of the heat shield block is avoided by means of the two side walls. The heat shield blocks are generally composed of a ceramic material, which tends to crack when subjected to a direct flow of cooling air. Moreover, the shape of the configuration according to the invention prevents the angled plate from being bent open by overheating or creep. The angled plate according to this configuration can furthermore be produced from a single piece by introducing a further U-shaped bend into the sheet-metal strip at the end of the second limb. According to one illustrative embodiment of this configuration of the invention, the first side wall can additionally be arranged on the shielding side wall, e.g. by angling the shielding side wall in the direction of the angle edge in the inlet region of the recess. However, this illustrative embodiment can also be implemented, for example, by means of an angled plate having a first and a second limb, on which a tubular piece, the rectangular cross section of which extends perpendicularly to the angle edge, is arranged.

Provision can furthermore advantageously be made for the reinforcing device to be implemented at least partially by means of profiling of the second limb.

Here, profiling of the second limb should be taken to mean shaping of the limb which deviates from the substantially planar extent of the limb, such as an undulating profile of the limb material or a quadrilateral fixed on the limb.

The second limb can advantageously have an undulating profile at least partially parallel to the angle edge.

The undulating profile allows reinforcement of the angled plate. The reinforcing device can be implemented exclusively by means of the undulating profile of the second limb, for example. Here, the undulating profile can be designed in such a way that at least one undulation comprises a lateral surface, which at least partially reflects cooling air flowing laterally out of the bolt head. In addition to the mechanical reinforcement of the angled plate brought about by means of the undulating profiling, this produces a cooling effect on the angled plate and hence a further increase in the dimensional stability of the component. The advantageous configuration of the invention can be produced from a standard component, upon which an undulating profile is imposed. This reduces production costs.

Provision can furthermore advantageously be made for the second limb to have an undulating profile at least partially perpendicularly to the angle edge.

This likewise allows implementation of the invention with reduced production costs. The undulating profile can extend over the entire width of the second limb, for example. Thus, the profiling extends partially behind the penetration region, as seen from the angle edge, and reinforces this region.

Provision can furthermore advantageously be made for the undulating profile to be sinusoidal, wherein the undulating profile traverses the sine function substantially from 0 to $2\pi$.

The formation of one undulation peak and one undulation trough is already sufficient to allow adequate reinforcement of the angled plate. This simplifies the production of the angled plate.

Another advantageous configuration of the invention can provide for two such recesses to be arranged on each of two opposite circumferential sides of the heat shield block, thus allowing the heat shield block to be secured to the support structure by means of four securing bolts arranged in opposite pairs.

This securing option allows particularly stable arrangement of the heat shield block on the support structure.

It can also be regarded as advantageous that the securing bolt is secured releasably to the support structure by means of a diaphragm spring assembly arranged on the support structure.

Provision can furthermore advantageously be made for a hole in alignment with the securing bolt to extend through the heat shield block from the hot side to the recess.

This allows simple access to the bolt head for an assembly tool.

It can also be regarded as advantageous that the reinforcing device of the angled plate comprises, in the penetration region, a reinforcing body which is arranged between the first and the second limb, projects into the aperture and is arranged by means of a lateral surface on the first limb and by means of an upper side on the second limb, wherein the reinforcing body has a through bore for the securing bolt, with the result that the securing bolt passes by means of a shank of the securing bolt through the penetration region and the reinforcing body.

The securing bolt can thus be inserted by means of its bolt shank into the angled plate through the penetration region of the second limb and the reinforcing body, with the result that the bolt head rests on the second limb and the shank projects through the second limb and through the reinforcing body. The angled plate is positioned on the circumferential surface of the heat shield block together with the bolt, with the second limb and the bolt head in the recess, and the reinforcing body and the bolt shank extending through the reinforcing body in the aperture.

Provision can advantageously be made for the reinforcing body to have a substantially semicircular upper side parallel to the second limb, wherein the straight side of the semicircle rests on the first limb.

The reinforcing body can thus have a semicircular cross section parallel to the second limb.

As an alternative, provision can be made for the upper side of the reinforcing body resting on the second limb to have substantially the shape of a triangle with a rounded apex, wherein the apex is rounded substantially to match the through bore, and the base of the triangle adjoins the first limb.

The reinforcing body can have a cross section corresponding to the triangular upper side over its entire height (perpendicularly to the second limb).

However, the height of the reinforcing body can be less at the apex than at the base, with the result that the shape of the reinforcing body corresponds substantially to that of a right prism with the rounded triangular shape as the base surface, wherein the side opposite the upper side is not arranged parallel to the upper side. The prism is thus of beveled design opposite the upper side. As a result, the side regions of the reinforcing body which extend perpendicularly to the second limb act as reinforcing ribs.

It can also be regarded as advantageous if the angled plate is designed as an integral casting with the reinforcing device.

In particular, it is thus possible to produce the angled plate together with the reinforcing body as an integral casting.

The material of the casting can be Nimonic 90, for example.

A number of such angled plates with a reinforcing device can be produced simultaneously by means of casting methods, especially "sprue molding". This reduces production costs.

It is another object of the invention to specify a combustion chamber lined with the heat shield mentioned at the outset, and a gas turbine having a combustion chamber of this kind, which allows securing of a heat shield block and avoids detachment of the heat shield block from the support structure in a particularly reliable manner.

According to the invention, this object is achieved, in the case of a combustion chamber of the type stated at the outset, by virtue of the fact that the heat shield is designed as respectively claimed.

This object is achieved, in the case of a gas turbine of the type stated at the outset, by virtue of the fact that at least one combustion chamber is designed as respectively claimed.

Further expedient configurations and advantages of the invention form the subject matter of the description of illustrative embodiments of the invention with reference to the figure of the drawing, wherein the same reference signs refer to components having the same effect.

DETAILED DESCRIPTION OF INVENTION

Figure 1:
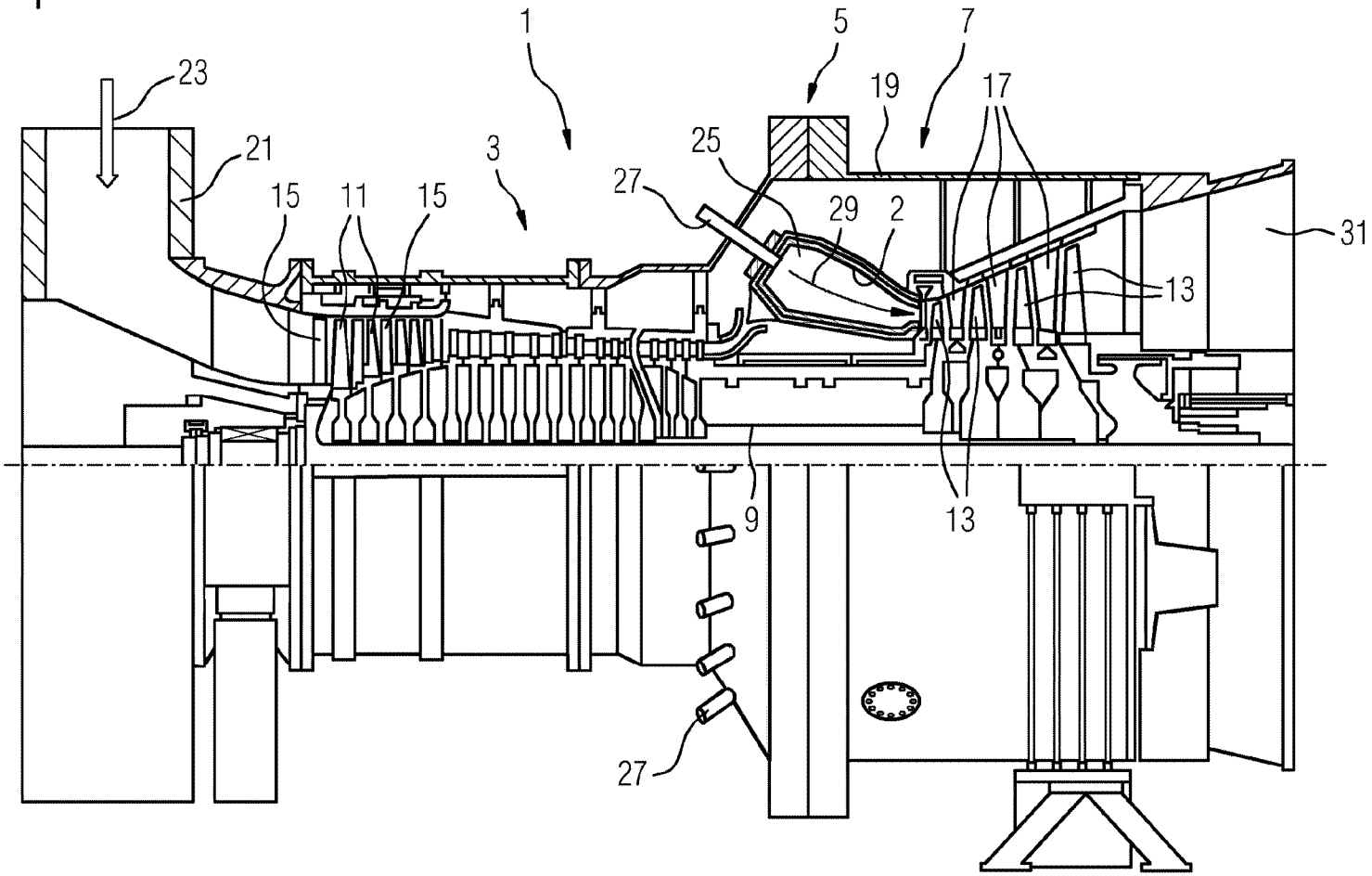
FIG. 1 shows a gas turbine according to the invention having a combustion chamber lined with a heat shield in a schematic sectional view.

FIG. 1 shows a gas turbine 1 in a schematic longitudinal section. This comprises a compressor section 3, a combustion chamber section 5 and a turbine section 7. A shaft 9 extends through all the sections of the gas turbine 1. In the compressor section 3, the shaft 9 is fitted with rings of compressor rotor blades 11 and, in the turbine section 7, with rings of turbine rotor blades 13. Rings of compressor guide vanes 15 are situated between the rotor blade rings in the compressor section 3, and rings of turbine guide vanes 17 are situated between the rotor blade rings in the turbine section 7. The guide vanes extend substantially in a radial direction to the shaft 9 from the housing 19 of the gas turbine system 1.

During the operation of the gas turbine 1, air 23 is drawn in through an air inlet 21 of the compressor section 3 and is compressed by the compressor rotor blades 11. The compressed air is fed to a combustion chamber 25, which is arranged in the combustion chamber section 5 and, in the illustrative embodiment under consideration, it is configured as an annular combustion chamber lined with a heat shield 2, into which a gaseous or liquid fuel is also sprayed via at least one burner 27. The air/fuel mixture thereby formed is ignited and burned in the combustion chamber 25. The hot combustion exhaust gases flow along the flow path 29 from the combustion chamber 25 into the turbine section 7, where they expand and cool and, in the process, transfer momentum to the turbine rotor blades 13. During this process, the turbine guide vanes 17 serve as nozzles for optimization of momentum transfer to the rotor blades 13. The rotation of the shaft 9 brought about by the momentum transfer is used to drive a load, e.g. an electric generator. Finally, the expanded and cooled combustion gases are discharged from the gas turbine 1 through an outlet 31.

Figure 2:
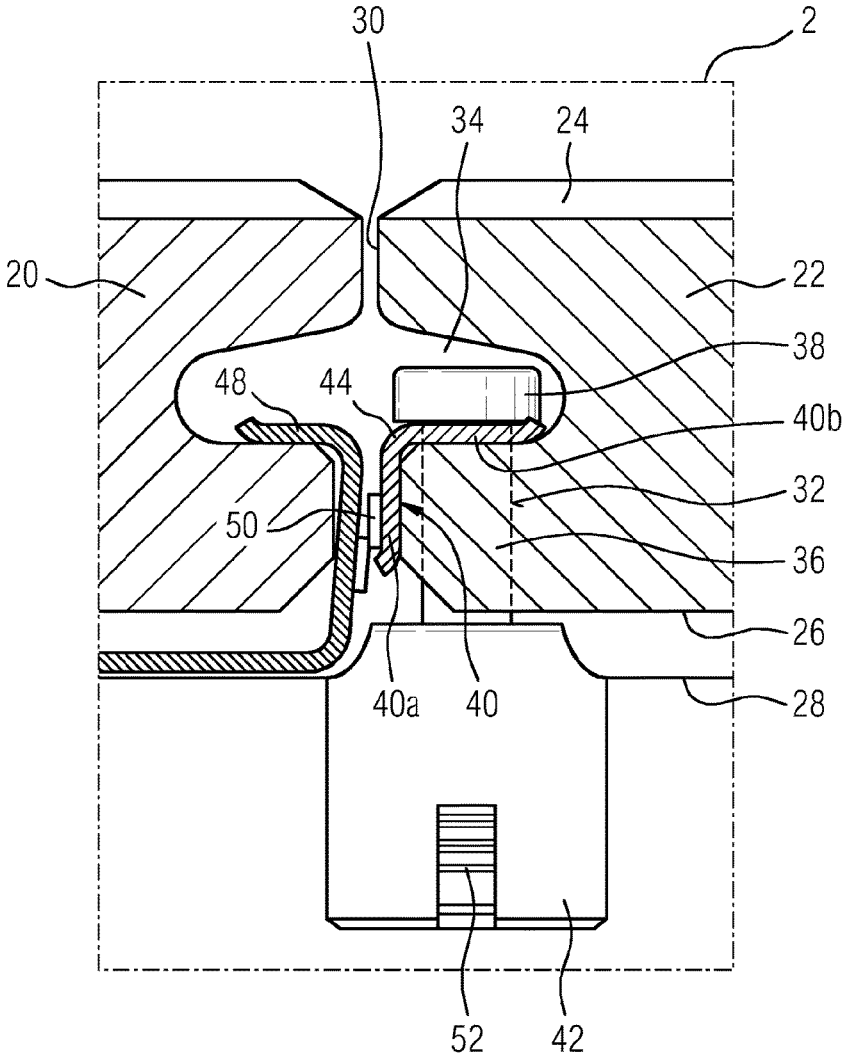
FIG. 2 shows a schematic detail of a heat shield according to the prior art in cross section.

FIG. 2 shows a detail of a heat shield 2 according to the prior art in cross section. Two mutually adjoining heat shield blocks 20, 22 are secured to a support structure 28. One heat shield block 20 is secured to the support structure by means of a holding element 48. The other heat shield block 22 is formed as a dummy block. To secure the dummy block, a circumferential side 30 of the heat shield block 22 which connects a hot side 24 to a cold side 26 facing the support structure 28 has a recess 34, which, in the example illustrated, is designed as a groove extending in the circumferential side 30. An aperture 32 connecting the recess 34 to the cold side 26 extends in the circumferential side 30 perpendicularly to the cold side 26. A securing bolt 36 is inserted into the aperture 32 to secure the heat shield block 22 to the support structure 28, with the result that a bolt head 38 of the securing bolt 36 projects into the recess. At the same time, the securing bolt 36 passes through an angled plate 40 in a penetration region, wherein the angled plate comprises a first limb 40*a* extending substantially parallel to the circumferential side 30 and a second limb 40*b* extending into the recess, wherein the two limbs 40*a*, 40*b* adjoin one another at an angle edge 44. The securing bolt 36 is held in the support structure by means of a securing device 42. The securing device 42 shown comprises a diaphragm spring assembly 52. The pressure acting on the heat shield block 22 via the bolt head 38 is distributed more uniformly owing to the angled plate 40. Moreover, the thermal expansion of the heat shield blocks 20, 22 is not hindered by means of the securing with an angled plate 40, a holding element 48 and a spacer 50.

Figure 3:
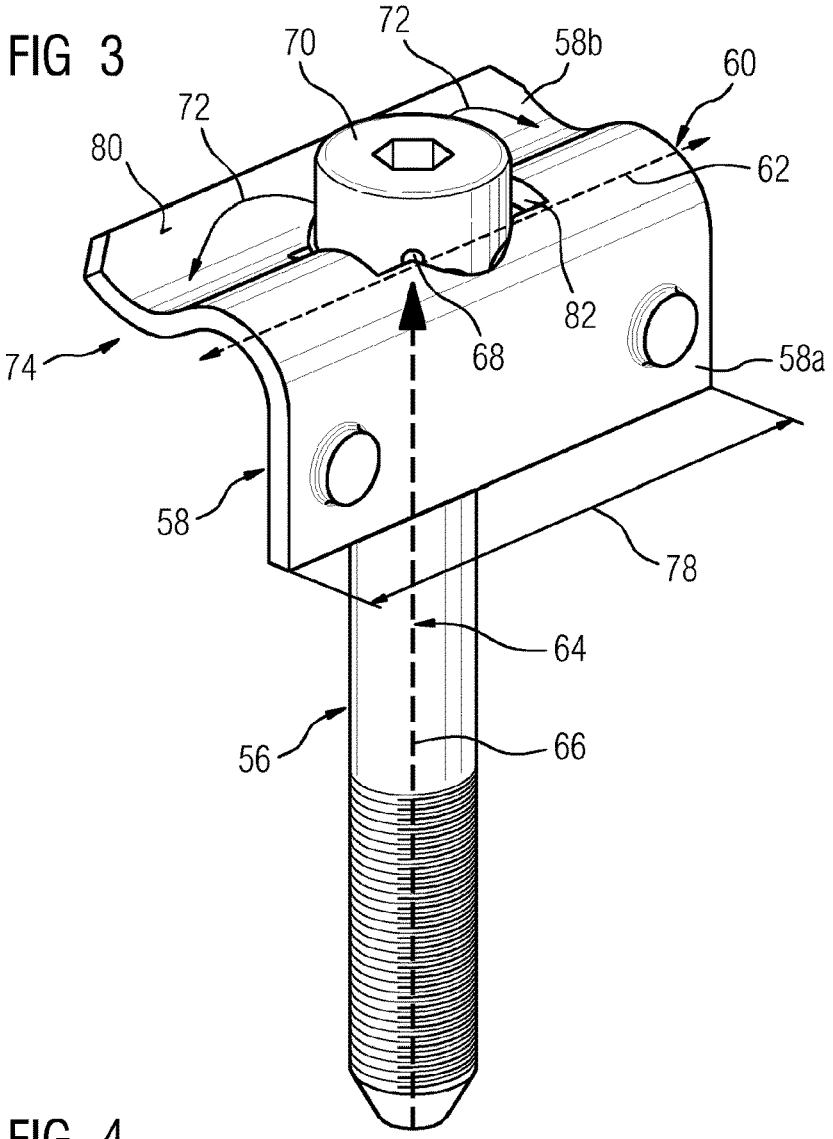
FIG. 3 shows an isolated illustration of a securing bolt with an angled plate according to a first illustrative embodiment of the invention in a perspective view and schematic representation.

FIG. 3 shows an isolated illustration of a securing bolt 56 with an angled plate 58 according to a first illustrative embodiment of the invention in a perspective view and schematic representation. The angled plate 58 has a first limb 58*a*, which can be arranged substantially parallel to a circumferential side of a heat shield block, and a second limb 58*b*, which adjoins the first limb 58*a* at an angle edge 60. The second limb 58*b* can project into a recess in a heat shield block (not shown). The course of the angle edge 60 is illustrated by means of the arrow 62.

The securing bolt 56 is internally cooled. For this purpose, the securing bolt according to the illustrative embodiment shown has a cooling air duct 64, which extends parallel to a longitudinal axis 66 of the securing bolt in the shank of the securing bolt 56. The cooling air duct 64 shown opens into four cooling air openings 68, which are arranged on the side of the bolt head 70. Cooling air flowing out of these cooling air openings 68 is illustrated by means of arrows 72. The second limb 58*b* has a reinforcing device 74, which increases the bending stiffness of the angled plate 58. In the illustrative embodiment shown, the reinforcing device 74 is formed by means of an undulating profile of region 58*b*. For this purpose, the reinforcing device 74 extends longitudinally over the entire width 78 of the angled plate, parallel to the angle edge 60. The second limb thus includes profiling, which extends at least partially behind the penetration region, as seen from the angle edge, and reinforces this region, with the result that a resistance of the angled plate to bending caused by the securing bolt is increased. The reinforcing device 74 also has a surface 80 which partially reflects cooling air 72 flowing out at the side of the bolt head 70. A penetration region penetrated by the securing bolt 56 is denoted by the reference sign 82.

Figure 4:
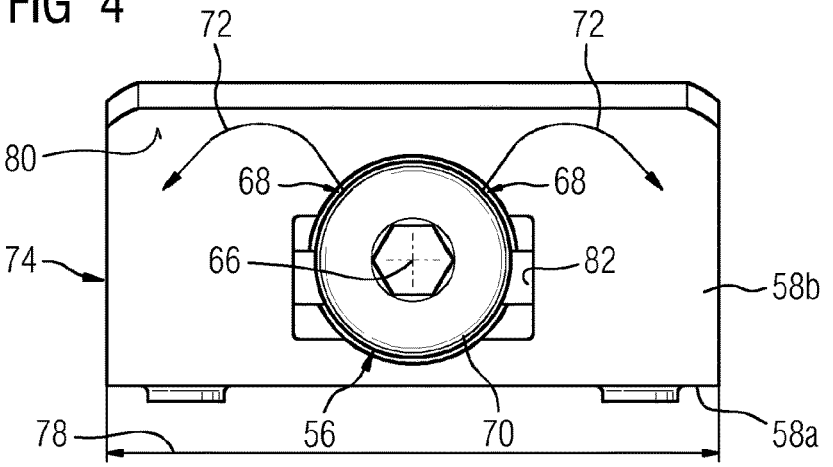
FIG. 4 shows the securing bolt with angled plate illustrated in FIG. 3 in plan view.

FIG. 4 shows the securing bolt 56 with angled plate 58 shown in FIG. 3 in a plan view. The securing bolt 56 passes through the angled plate 58 in the region of a penetration region 82 arranged in limb 58*b*. The reinforcing device 74 extends longitudinally over the entire width 78 of the angled plate 58. The cooling air 72 flowing out of the cooling air openings 68 is at least partially reflected by the surface 80 of the reinforcing device 74.

Figure 5:
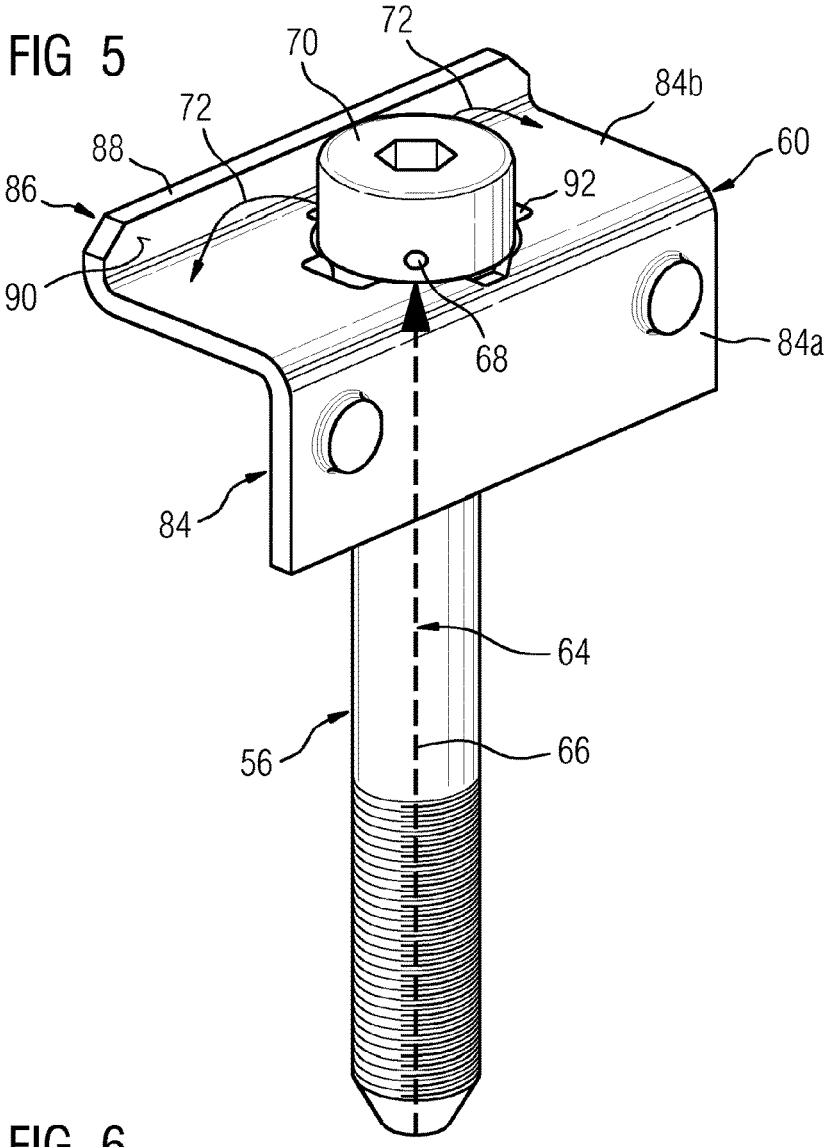
FIG. 5 shows an isolated illustration of a securing bolt with an angled plate according to a second illustrative embodiment of the invention in a perspective view and schematic representation.

FIG. 5 shows an isolated illustration of a securing bolt 56 with an angled plate 84 according to a second illustrative embodiment of the invention in a perspective view and schematic representation. This configuration of the securing bolt corresponds to the configuration of the securing bolt 56 shown in FIG. 3. For this reason, the reference signs given in respect of the securing bolt 56 are the same as those in FIG. 3. The angled plate 84 differs from the angled plate 58 in FIG. 3 in that the reinforcing device 86 is implemented in a different way. For this purpose, the angled plate 84 has a side wall 88 angled in the opposite direction to the angle edge 60 on the opposite side of its second limb 84*b* from the angle edge. As seen from the angle edge, the side wall 88 extends partially behind the penetration region 92 and reinforces this region behind the penetration region 92. In this second illustrative embodiment, the reinforcing device 86 is implemented by means of the side wall 88, wherein the side wall 88 comprises a surface 90 which at least partially reflects cooling air 72 flowing out of the bolt head 70 at the side.

Figure 6:
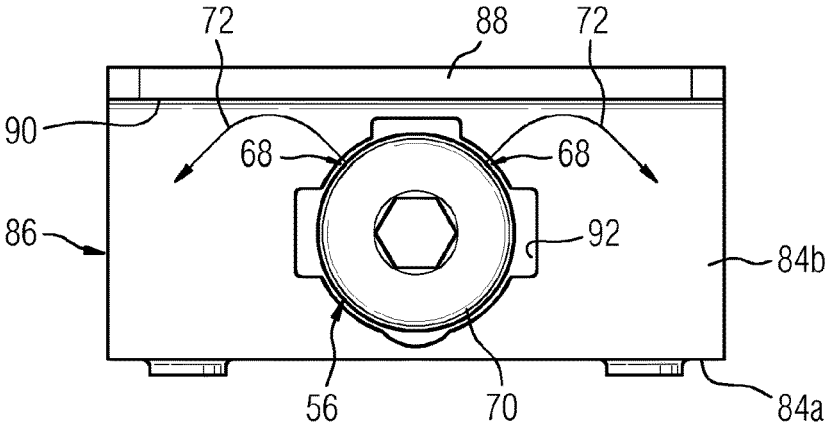
FIG. 6 shows the securing bolt illustrated in FIG. 5 with the angled plate in a plan view.

FIG. 6 shows the securing bolt 56 illustrated in FIG. 5 with the angled plate 84 in a plan view and having a first limb 84*a* and a second limb 84*b*. The securing bolt 56 passes through the second limb 84*b* of the angled plate 84 in a penetration region 92. The reinforcing device 88 extends longitudinally over the entire width of the second limb 84*b*. The cooling air 72 emerging from the cooling air openings 68 is at least partially reflected by the surface 90 of the reinforcing device 88.

Figure 7:
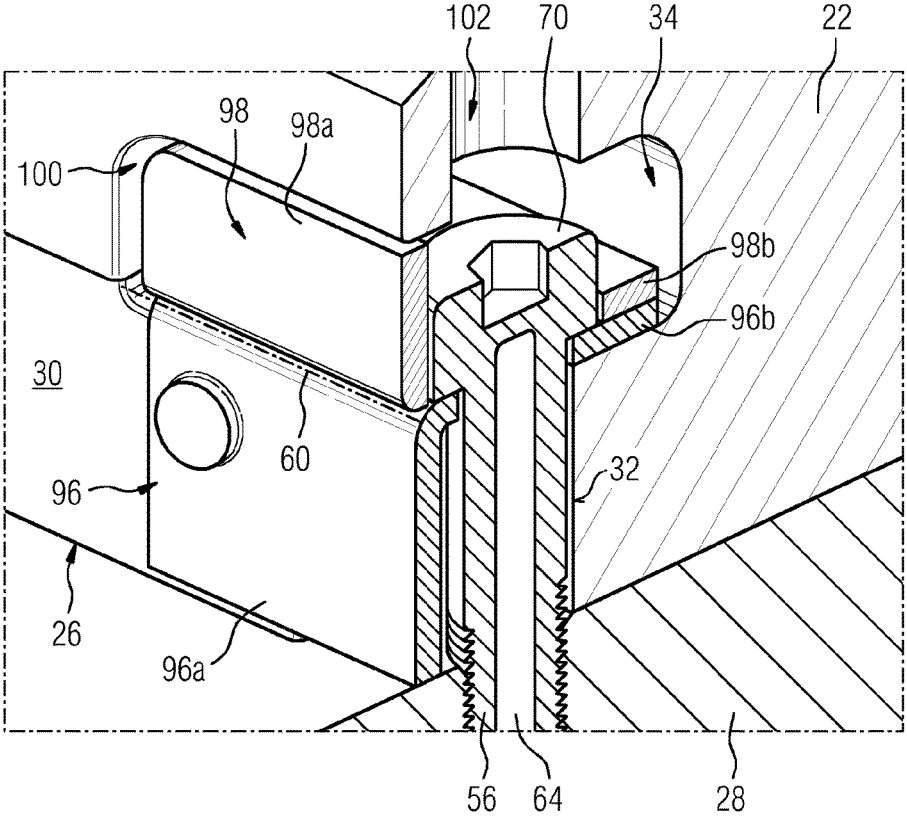
FIG. 7 shows a schematic detail of a heat shield according to the invention in the securing region of a heat shield block with an angled plate according to a third illustrative embodiment of the invention in sectioned view.

FIG. 7 shows a detail of a heat shield according to the invention in the region of a heat shield block 22. The heat shield block 22 has a hot side (not shown), a cold side 26 facing the support structure 28, and a circumferential side 30 connecting the hot side to the cold side 26 and having a recess 34. An aperture 32 connecting the recess to the cold side extends in the circumferential side 30 perpendicularly to the cold side 26. To secure the heat shield block 22, a securing bolt 56 is inserted into the aperture 32, with the result that a bolt head 70 of the securing bolt 56 projects into the recess 34. The securing bolt 56 passes through an angled plate 96 having a first limb 96*a* and a second limb 96*b*, which projects into the recess, wherein the two limbs adjoin one another at an angle edge 60. In the illustrative embodiment under consideration, the angle edge 60 is a rounded transitional region between the first and the second limb. The angled plate 96 comprises a reinforcing device 98 according to a third illustrative embodiment of the invention, having a first side wall 98*a*, which is arranged in the region of the inlet opening 100 of the recess 34 and substantially closes the latter. The first side wall 98*a* is arranged substantially at right angles on a second side wall 98*b* of the reinforcing device 98. In this case, the second side wall 98*b* extends along the second limb 96*b* and has an opening in alignment with the penetration region of the second limb 96*b*. The opening can be designed in such a way that the bolt head 70 rests on the second side wall 98*b*. In the example shown, the opening is designed in such a way that the bolt head 70 extends through the opening and rests on the second limb 96*b*. As a result, the securing bolt head 70 is arranged so as to be recessed in the second side wall 98*b*.

In its interior, the securing bolt 56 comprises a cooling air duct 64, which opens into outlet openings arranged laterally on the bolt head 70. The cooling air flowing out at the side of the bolt head 70 is held in the recess 34 owing to the first side wall 98*a* and flows out with a time delay, e.g. through the assembly opening 102. The reinforcing device 98 leads to significantly improved cooling of the angled plate 96, with the result that dimensional stability of the angled plate 96 comprising the reinforcing device 98 is increased. The angled plate 96 comprising the reinforcing device 98 has increased resistance to a force in the direction of the support structure 28 exerted on the angled plate by the securing bolt 56.

Figure 8:
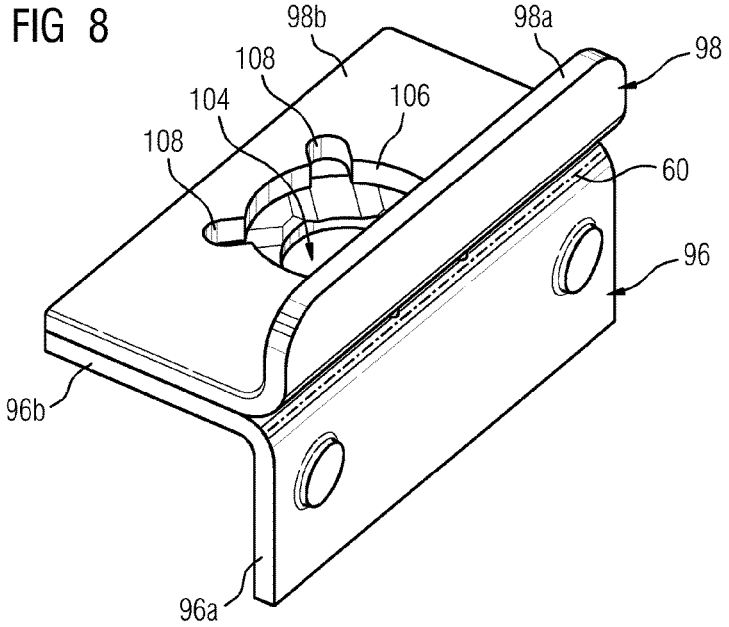
FIG. 8 shows a schematic isolated illustration of the angled plate shown in FIG. 7 in perspective view.

FIG. 8 shows the angled plate 96 illustrated in FIG. 7 with the reinforcing device 98 comprised by the angled plate 96 in a perspective isolated illustration. The angled plate 96 comprises a first limb 96*a* and a second limb 96*b*, which adjoin one another at an angle edge 60. The reinforcing device 98 comprises a first side wall 98*a* and a second side wall 98*b*, which likewise adjoin one another in the region of an angle edge, wherein this angle edge extends parallel to angle edge 60. The second side wall 98*b* is arranged on the second limb 96*b* and has an opening 106, which is in alignment with the penetration region 104 of the second limb and the diameter of which corresponds approximately to the diameter of the bolt head (not shown). Apertures 108 are arranged at the circumference of the opening 106. According to the illustrative embodiment shown, the apertures 108 have the form of grooves with a semicircular face in the end region. The height of the grooves can extend over the entire thickness of the second side wall 98*b*, for example.

Figure 9:
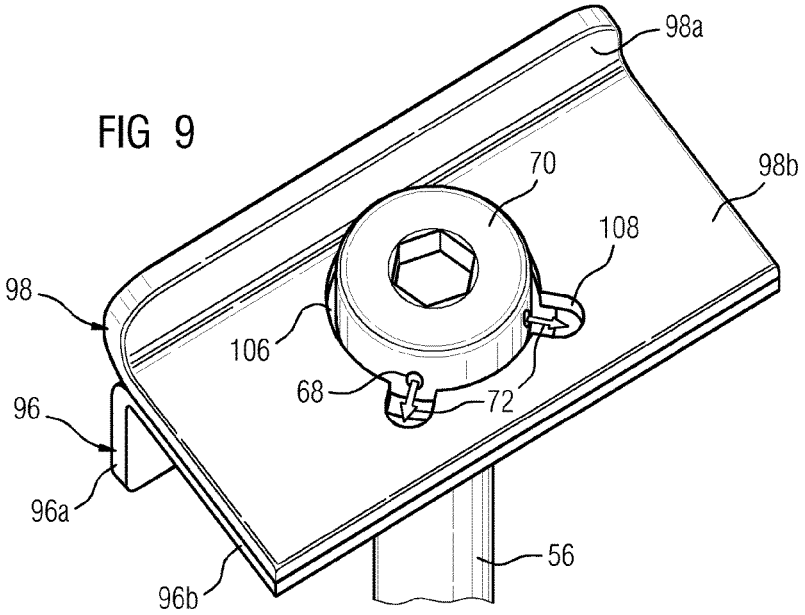
FIG. 9 shows the angled plate of FIG. 8 in a perspective plan view.

FIG. 9 shows the angled plate 96 illustrated in FIG. 8 in a perspective plan view and with a securing bolt 56 extending through the opening 106 and the penetration region 104. According to the illustrative embodiment shown, the securing bolt 56 comprises a cooling air duct (not shown), which opens at the side of the bolt head 70 into at least one outlet opening 68, wherein an aperture 108 extending as far as the circumference of the opening 106 is arranged in the second side wall 98*b* in the region of at least one outlet opening 68 of the cooling air duct 56. The cooling air emerging from the outlet openings 68 is shown schematically by means of arrows 72. Owing to impact cooling of its side walls and, in particular, to impact cooling of its aperture, the aperture 108 increases the cooling effect of the cooling air 72 guided into the outlet. When the heat shield block is subjected to hot gas, this leads to a further improvement in cooling, especially of the second side wall 98*b* and of the second limb 96*a* of the angled plate 96.

Figure 10:
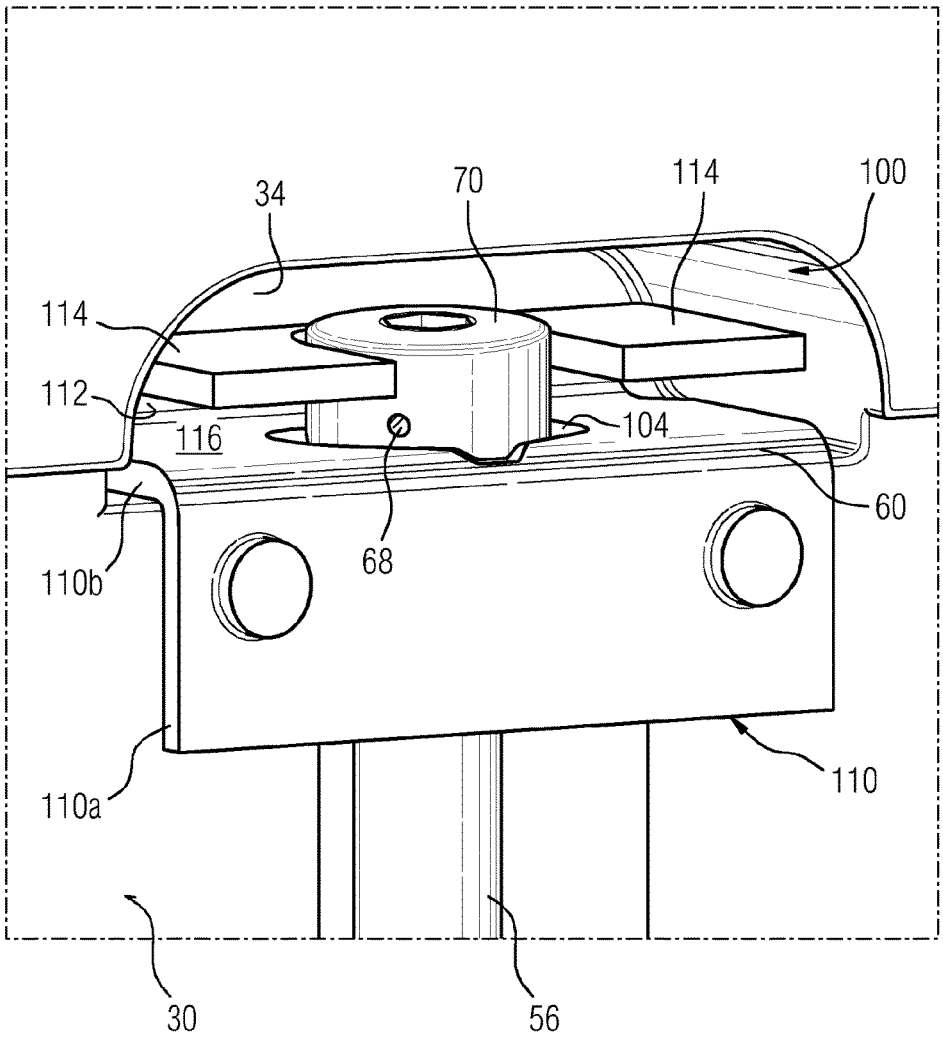
FIG. 10 shows a detail of a heat shield according to the invention in the region of a circumferential side of the heat shield block, said side having a recess and an angled plate, according to a fourth illustrative embodiment of the invention.

FIG. 10 shows a detail of a heat shield according to the invention in a perspective view of a circumferential side 30 of a heat shield block in the recess region 34 with an angled plate 110 having a first limb 110*a* and a second limb 110*b* according to a fourth illustrative embodiment of the invention. The angled plate 110 comprises a reinforcing device which extends over the entire width of the second limb 110*b* and extends partially behind the penetration region 92, as seen from the angle edge 60, and reinforces this region. Similarly to the illustrative embodiment shown in FIGS. 5 and 6, the second limb 110*b* of the angled plate 110 has a side wall 112 which is angled in the opposite direction to the angle edge 60 at its side opposite the angle edge 60 and which extends behind the penetration region 92, as seen from the angle edge 60, and reinforces this region. As a departure from the illustrative embodiment shown in FIGS. 5 and 6, a shielding side wall 114, which extends as far as the inlet opening 100 of the recess 34, is arranged on the angled side wall 112, with a vertical clearance. The shielding side wall 114 comprises an aperture for the bolt head 70.

The shielding side wall 114 shields the second limb 110*b* from the entry of hot gas. Owing to the reduced ambient temperature, this increases dimensional stability of the angled plate 110. Owing to its shape, the angled plate 110 furthermore has increased resistance of the angled plate 110 to bending caused by the securing bolt 56. In addition, a cooling air space 116, which is delimited by the angled side wall 112 and the shielding side wall 114 and into which cooling air emerging at the side of the bolt head 70 of the securing bolt 56 is directed back onto the angled plate 110, thus increasing the dwell time of the cooling air in the recess 34, is achieved.

Figure 11:
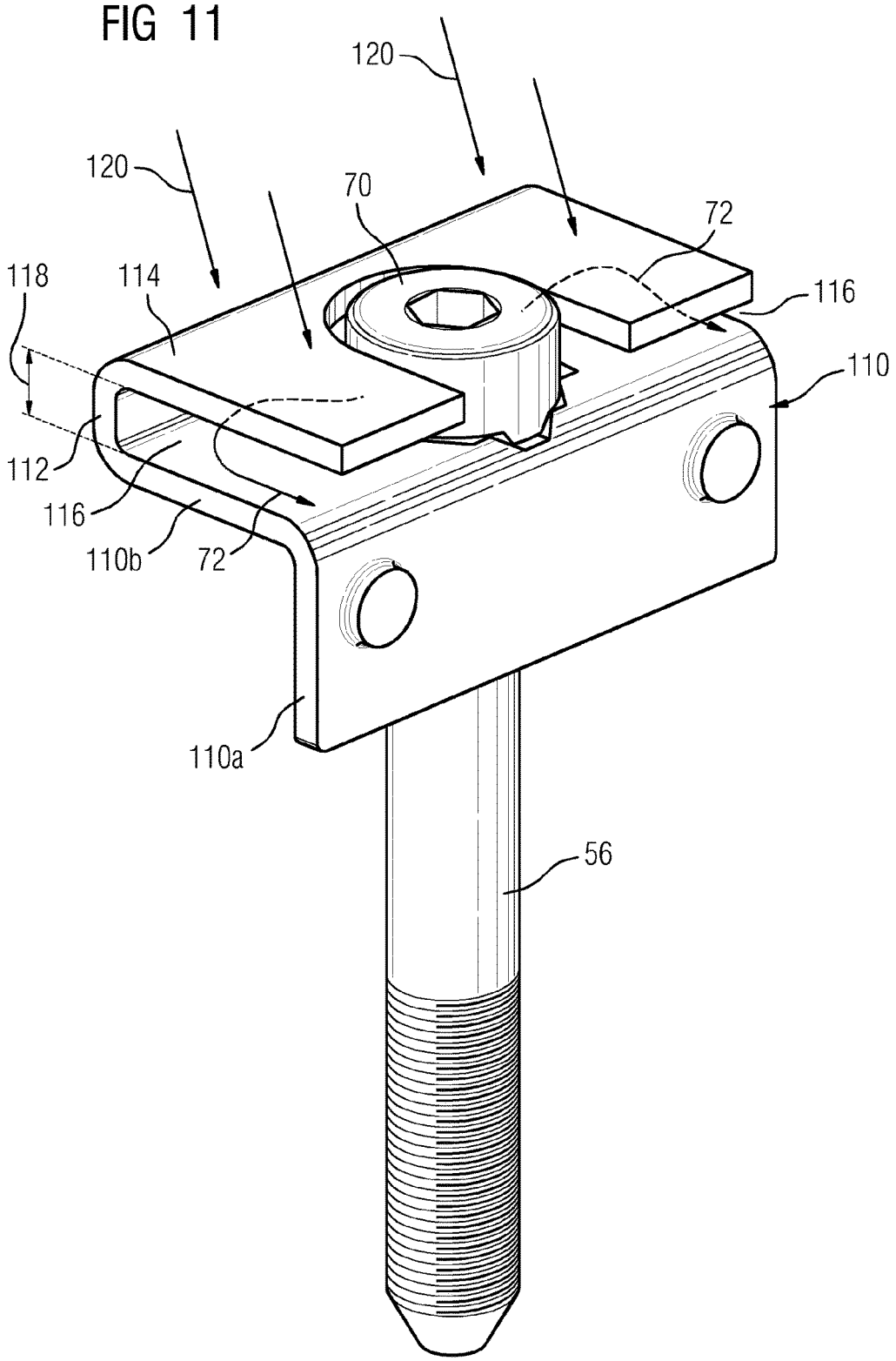
FIG. 11 shows an isolated illustration of the angled plate shown in FIG. 10 with the securing bolt in place.

FIG. 11 is an isolated illustration of the angled plate 110 shown in FIG. 10 with the securing bolt 56 in place. The shielding side wall 114 is arranged on the angled side wall 112 with the vertical clearance 118. This shielding side wall shields the second limb 110*b* from hot gas, wherein the hot gas is denoted schematically in a highly simplified form by means of the arrows 120. The cooling air space 116 delimited by means of the angled side wall 112 and the shielding side wall 114 and by means of the second limb 110*b* serves to increase the dwell time of cooling air 72. The cooling air 72 emerging at the side of the bolt head 70 is diverted by the side walls of the cooling air space 116 and flows back onto the angled plate 110. Owing to the temperature reduction caused thereby, dimensional stability of the angled plate 110 is increased.

Figure 12:
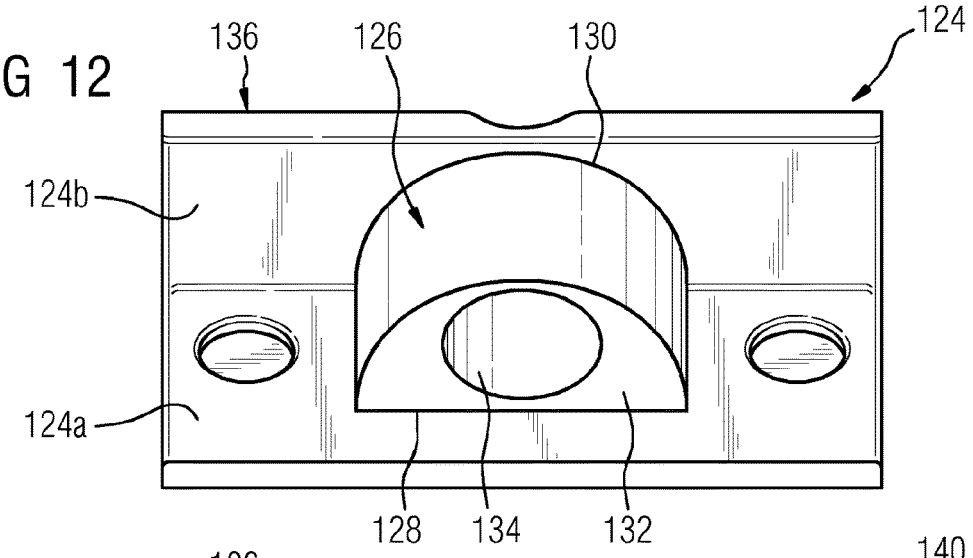
FIG. 12 shows a schematic perspective view of an angled plate according to the invention with a reinforcing body according to a fifth illustrative embodiment.

FIG. 12 shows an angled plate 124 having a reinforcing body 126. The angled plate comprises a first limb 124*a* and a second limb 124*b* and a penetration region for a securing bolt. Arranged in the region of the penetration region is a reinforcing body 126, a semicircular upper side 130 of which adjoins the second limb 124*b* and a lateral surface 128 of which adjoins the first limb 124*a*. A bore 134 for the insertion of a securing bolt passes through the reinforcing body 126. The cross section 132 of the reinforcing body and the diameter of the bore 134 are chosen in such a way that a securing bolt can be inserted into the angled plate, rests by means of a bolt head on the upper side 136 of the second limb and extends by means of the bolt shank through the penetration region and the reinforcing body 126. The cross section of the reinforcing body is chosen in such a way that the reinforcing body can be placed in an aperture on a lateral surface of a heat shield block, wherein the second limb projects into a recess in the lateral surface.

Figure 13:
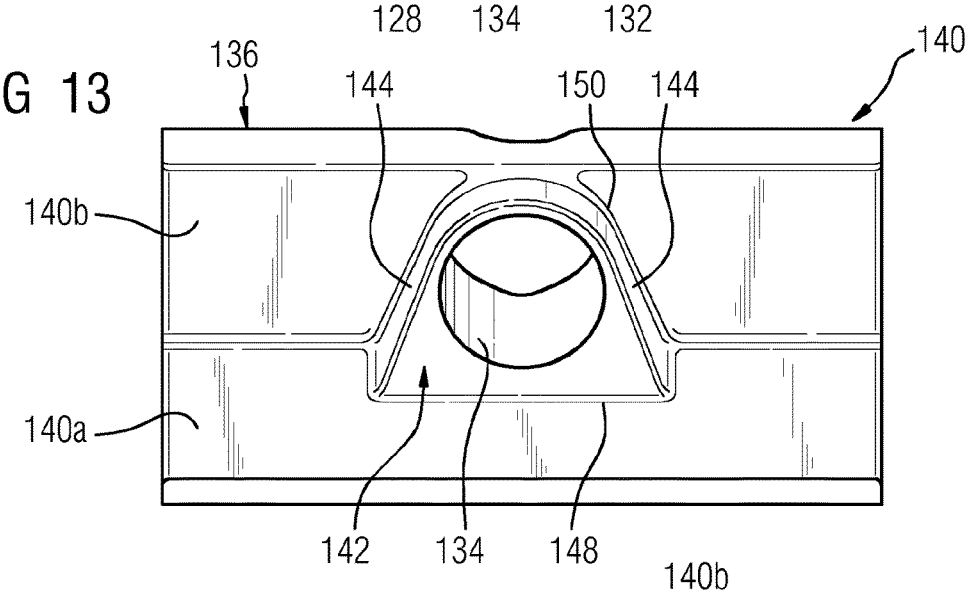
FIG. 13 shows a schematic perspective view of an angled plate according to the invention with a reinforcing body according to a sixth illustrative embodiment.

FIG. 13 shows an angled plate 140 having an alternative illustrative embodiment of the reinforcing body 142. The upper side 150 of the reinforcing body 142, said side resting on the second limb 140*b*, has substantially the shape of a triangle with a rounded apex, wherein the apex is rounded substantially to match the through bore 134 and the base of the triangle (edge of the lateral surface 148) adjoins the first limb 140*a*.

Perpendicularly to the second limb 140*b*, at the apex of the triangular upper side 150, the reinforcing body 142 has a smaller height than at the base, with the result that the reinforcing body 142 has substantially the shape of a prism with the upper side 150 as a base surface, wherein the prism is beveled opposite the upper side.

Figure 14:
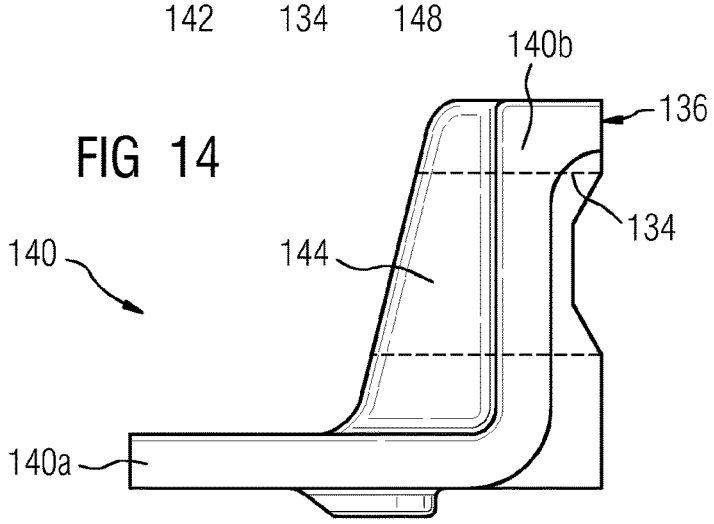
FIG. 14 shows the angled plate illustrated in FIG. 13 in a schematic side view.

FIG. 14 shows the angled plate from FIG. 13 in a side view. In this view, the lateral surface 144 of the reinforcing body 142 can be seen. The region of the lateral surfaces 144 forms a reinforcing rib on each side. For improved contact with a bolt head, the upper side 136 of the angled plate comprises a raised contact region for the bolt head in the penetration region. This further increases the resistance of the angled plate to bending caused by the securing bolt.

The invention claimed is:

1. A heat shield adapted for a gas turbine that comprises at least one combustion chamber, the heat shield comprising:

a support structure and a number of heat shield blocks, wherein the number of heat shield blocks are secured to the support structure and each comprises a cold side exposed to cooling air and facing the support structure and a hot side exposed to hot gases and opposite the cold side, and, in at least one heat shield block of the number of heat shield blocks, at least one recess is arranged in at least one circumferential side of the at least one heat shield block, said at least one circumferential side connecting the cold side to the hot side, an aperture, which connects the at least one recess to the cold side, extending in the at least one circumferential side perpendicularly to the cold side, a securing bolt adapted to be inserted into the aperture to secure the at least one heat shield block to the support structure, such that a bolt head of the securing bolt projects at least partially into the at least one recess and simultaneously the securing bolt passes through an angled plate in a penetration region of the angled plate, wherein the angled plate comprises a first limb, which extends substantially parallel to the at least one circumferential side, and a second limb, which extends into the at least one recess, wherein the first limb and the second limb adjoin each other at an angle edge, wherein the angled plate comprises a cold side of the angled plate that at least partly abuts the at least one heat shield block and a hot side of the angled plate opposite the cold side of the angled plate, wherein the angled plate comprises a reinforcing device that increases a resistance of the angled plate to bending caused by the securing bolt, and wherein the reinforcing device comprises a first side wall disposed on a side of the bolt head toward a mouth of the at least one recess and comprising: a first side wall cold end that runs along the angle edge on the hot side of the angled plate; and a first side wall hot end disposed between the first side wall cold end and the hot side of the at least one heat shield block, such that the first side wall extends across the mouth of the at least one recess, thereby at least partly closing the at least one recess and shielding the bolt head from hot gases present at the hot side during operation.

2. The heat shield as claimed in claim 1, wherein at least one surface of the reinforcing device at least partially reflects cooling air emerging at a side of the bolt head.

3. The heat shield as claimed in claim 1, wherein the first side wall closes the mouth of the at least one recess substantially completely.

4. The heat shield as claimed in claim 1, wherein the first side wall is arranged substantially at right angles on a second side wall of the reinforcing device, wherein the second side wall rests atop and extends along the second limb and the second side wall comprises a bolt opening in alignment with the penetration region of the second limb.

5. The heat shield as claimed in claim 4, wherein the securing bolt comprises at least one cooling air duct, which opens at a side of the bolt head in at least one outlet opening, wherein an aperture extending as far as a circumference of the bolt opening is arranged in the second side wall in a region of the at least one outlet opening of the at least one cooling air duct.

6. The heat shield as claimed in claim 1, wherein the reinforcing device extends at least partially behind the penetration region, as seen from the angle edge, and reinforces the penetration region.

7. The heat shield as claimed in claim 6, wherein the second limb of the angled plate or a second side wall of the reinforcing device comprises, on a side opposite the angle edge, a side wall which is angled in an opposite direction to the angle edge, extending at least partially behind the penetration region, as seen from the angle edge, and reinforces the penetration region.

8. The heat shield as claimed in claim 1, wherein the reinforcing device is implemented at least partially by means of profiling of the second limb.

9. The heat shield as claimed in claim 8, wherein the second limb comprises an undulating profile at least partially parallel to the angle edge.

10. The heat shield as claimed in claim 8, wherein the second limb comprises an undulating profile at least partially perpendicularly to the angle edge.

11. The heat shield as claimed in claim 9, wherein the undulating profile is sinusoidal, wherein the undulating profile traverses a sine function substantially from 0 to $2\pi$.

12. The heat shield as claimed in claim 1, wherein the at least one circumferential side comprises two opposite circumferential sides; and wherein the at least one recess comprises two such recesses each arranged on a respective circumferential side of the two opposite circumferential sides of the at least one heat shield block, thus allowing the at least one heat shield block to be secured to the support structure by means of four securing bolts arranged in opposite pairs.

13. The heat shield as claimed in claim 1, wherein the securing bolt is secured releasably to the support structure by means of a diaphragm spring assembly arranged on the support structure.

14. The heat shield as claimed in claim 1, further comprising:

a hole in alignment with the securing bolt extending through the at least one heat shield block from the hot side to the at least one recess.

15. The heat shield as claimed in claim 1, wherein the reinforcing device of the angled plate comprises, in the penetration region, a reinforcing body which is arranged between the first limb and the second limb, that projects into the aperture and is arranged by means of a lateral surface on the first limb and by means of an upper side on the second limb, wherein the reinforcing body comprises a through bore for the securing bolt, such that the securing bolt passes by means of a shank of the securing bolt through the penetration region and the reinforcing body.

16. The heat shield as claimed in claim 15, wherein the reinforcing body comprises a substantially semicircular upper side parallel to the second limb, wherein a straight side of the semicircle rests on the first limb.

17. The heat shield as claimed in claim 15, wherein the upper side of the reinforcing body resting on the second limb comprises substantially a shape of a triangle with a rounded apex, wherein the rounded apex is rounded substantially to match the through bore, and a base of the triangle adjoins the first limb.

18. The heat shield as claimed in claim 17, wherein a height of the reinforcing body perpendicularly to the second limb is less at the rounded apex of a triangular upper side than at the base, such that the reinforcing body comprises substantially a shape of a prism with the triangular upper side as the base, wherein the prism is beveled opposite the triangular upper side.

19. The heat shield as claimed in claim 15, wherein the angled plate is designed as an integral casting with the reinforcing device.

20. A combustion chamber, comprising:

the heat shield, designed as claimed in claim 1.

21. A gas turbine, comprising:

at least one combustion chamber, designed as claimed in claim 20.

* * * * *